US008545319B2

(12) United States Patent
Kaneko

(10) Patent No.: US 8,545,319 B2
(45) Date of Patent: Oct. 1, 2013

(54) MULTI-HAND SLOT MACHINE THAT DISPLAYS ALL LOSING HAND OUTCOMES PRIOR TO DISPLAYING WINNING HAND OUTCOMES

(75) Inventor: Makoto Kaneko, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 24 days.

(21) Appl. No.: 13/378,141

(22) PCT Filed: Feb. 5, 2010

(86) PCT No.: PCT/JP2010/051666

§ 371 (c)(1),
(2), (4) Date: Dec. 19, 2011

(87) PCT Pub. No.: WO2010/146886

PCT Pub. Date: Dec. 23, 2010

(65) Prior Publication Data

US 2012/0115577 A1 May 10, 2012

(30) Foreign Application Priority Data

Jun. 19, 2009 (JP) ..... 2009-146891

(51) Int. Cl.
*A63F 9/24* (2006.01)

(52) U.S. Cl.
USPC ..... 463/31; 463/20; 463/25; 463/30

(58) Field of Classification Search
USPC ..... 463/20, 25, 30, 31
See application file for complete search history.

(56) References Cited

U.S. PATENT DOCUMENTS

| | | | | |
|---|---|---|---|---|
| 5,934,672 | A * | 8/1999 | Sines et al. | 273/143 R |
| 6,203,428 | B1 * | 3/2001 | Giobbi et al. | 463/16 |
| 7,527,557 | B2 * | 5/2009 | Jackson | 463/20 |
| 8,177,625 | B2 * | 5/2012 | Borissov et al. | 463/20 |
| 8,388,435 | B2 * | 3/2013 | Anderson et al. | 463/20 |
| 2005/0049033 | A1 * | 3/2005 | Kojima | 463/20 |

(Continued)

FOREIGN PATENT DOCUMENTS

| | | |
|---|---|---|
| JP | 2002-119693 | 4/2002 |
| JP | 2002-126166 | 5/2002 |

(Continued)

OTHER PUBLICATIONS

International Search Report issued Mar. 2, 2010 in International (PCT) Application No. PCT/JP2010/051666.

*Primary Examiner* — Lawrence Galka
(74) *Attorney, Agent, or Firm* — Wenderoth, Lind & Ponack, L.L.P.

(57) ABSTRACT

A game machine includes a game result determining device for determining a game result when a predetermined condition is established, a device for generating video of reels where symbols are displayed in a changing condition and then displayed in a stopped condition, a display device having a video display screen, a game image generating device for displaying video of a plurality of reels, a losing reel ascertaining device for ascertaining a losing reel on the basis of the game result ascertained, a winning reel ascertaining device for ascertaining a winning reel, a losing reel stopping device for displaying the symbols of the losing reel, and a winning reel stopping device for displaying the symbols of the winning reel in a stopped condition after the symbols of all of the losing reels have been displayed by the losing reel stopping device.

9 Claims, 12 Drawing Sheets

(56) References Cited

U.S. PATENT DOCUMENTS

| | | | | |
|---|---|---|---|---|
| 2008/0064480 | A1* | 3/2008 | Randall | 463/20 |
| 2008/0153575 | A1* | 6/2008 | Okada | 463/20 |
| 2008/0188281 | A1* | 8/2008 | Yoshizawa | 463/20 |
| 2008/0214296 | A1* | 9/2008 | Yoshizawa | 463/27 |

FOREIGN PATENT DOCUMENTS

| | | |
|---|---|---|
| JP | 2008-148753 | 7/2008 |
| JP | 2008-148789 | 7/2008 |
| JP | 2008-178474 | 8/2008 |
| JP | 2008-183216 | 8/2008 |

* cited by examiner

LT

| RANDOM NUMBER VALUE | 1~3 | 4~9 | 10~99 | 100~199 | 200~999 |
|---|---|---|---|---|---|
| WINNING COMBINATION | 7 COMBINATION | BAR COMBINATION | BELL COMBINATION | CHERRY COMBINATION | — |
| NUMBER OF DISPENSING MEDALS | 500 MEDALS | 200 MEDALS | 15 MEDALS | 5 MEDALS | — |

MULTI-HAND SLOT MACHINE THAT DISPLAYS ALL LOSING HAND OUTCOMES PRIOR TO DISPLAYING WINNING HAND OUTCOMES

BACKGROUND OF THE INVENTION

I. Technical Field

The present invention relates to a game machine such as a slot machine, a pachisuro game machine (rotary drum type game machine), or a pachinko game machine, which is installed in a game facility, and has rotation reels capable of displaying symbols in a changing condition. In particular, the present invention relates to a game machine and a program capable of simultaneously executing a plurality of symbol display games.

II. Description of the Related Art

In a game machine, such as a slot machine, a pachisuro game machine, or a pachisuro game machine, a symbol display game is executed in which, when a predetermined condition is established, one or a plurality of symbols are displayed in a changing condition, a game result is decided by a lottery or the like, and symbols according to the game result are stopped and displayed after a predetermined time has elapsed or in response to an operation of a player.

The above-described symbol display game may be called a reel game because there are many cases where one or a plurality of cylinders (reels) having a plurality of symbols arranged on the peripheral surface are rotated and stopped when the game is executed.

In recent years, a game machine using virtual reels (a simulation video of reels), instead of mechanical reels made of actual cylinders, or a game machine having a liquid crystal display configured to display a video, such as animation, in addition to reels for a symbol display game may be used.

In the game machine which executes the above-described symbol display game, for example, if a remaining one symbol is arranged, a win (also referred to as "winning prize" or "prize") occurs, that is, the game machine is in a so-called reach state. In the reach state, a predetermined performance process is performed which includes changing the rotation speed or the rotation direction of the reels, displaying a specific animation image, or the like. In a game machine which automatically stops the symbols, in order that a player could be notified of the remaining time of a game, a game machine is known which has a unit (for example, a level indicator which displays the remaining time in a bar graph) for displaying the remaining time from the start of the changing the symbols to the automatic stop of the symbols (for example, see Japanese Patent Application Laid-Open No. 2002-126166).

Patent Literature 1 Japanese Patent Application Laid-Open No. 2002-126166

SUMMARY OF THE INVENTION

As described above, in the game machine which executes the symbol display game, for example, in the reach state, a predetermined performance process is performed for the player, for example, the rotation speeds or rotation directions of the reels are changed, a specific animation image appears, or the like. The performance process improves a sense of expectation of a jackpot or a sense of exaltation when a win has occurred.

On the other hand, when a win does not occur after the reach state and a payout is 0, the player feels a heavy sense of disappointment, the game time per game is extended, and temporal stress is imposed on the player, thereby causing the player to lose interest. In the game machine which automatically stops the symbols, it takes the same time until the reels are stopped even when a predetermined performance process is not performed. Accordingly, even when a game is repeatedly executed in the same game machine, it generally takes a lot of time until a jackpot is hit. For this reason, a person who tries to reach a conclusion in a short period of time is apt to avoid playing in the game machine which executes the above-described symbol display game.

The invention has been finalized in consideration of the above-described situation, and a primary object of the invention is to provide a game machine capable of significantly reducing the time until a jackpot is hit without changing the payback ratio (return ratio) or ratio of occurrence of a jackpot for a player.

The invention relates to a game machine and a program capable of simultaneously executing a plurality of symbol display games. The above-described object of the invention will be attained by the following configuration.

A game machine includes a game result determining unit for determining a game result when a predetermined condition is established, a reel video generating unit for generating a video of reels where symbols are displayed in a changing condition and then displayed in a stopped condition in accordance with the game result, a display unit having a video display screen on which the video is displayed, a game image generating unit for displaying a video of a plurality of reels on the video display screen, a losing reel ascertaining unit for ascertaining a losing reel from among the plurality of reels on the basis of the game result determined by the game result determining unit, a winning reel ascertaining unit for ascertaining a winning reel from among the plurality of reels on the basis of the game result determined by the game result determining unit, a losing reel stopping unit for displaying the symbols of the losing reel ascertained by the losing reel ascertaining unit in a stopped condition, and a winning reel stopping unit for displaying the symbols of the winning reel in a stopped condition after the symbols of all of the losing reels have been displayed in a stopped condition by the losing reel stopping unit.

The object of the invention will be attained more effectively by the following configuration.

The winning reel is a reel where it is assured that a win occurs when the symbols are displayed in a stopped condition.

The game machine further includes an operating unit for starting to change the symbols in the plurality of reels in response to an operation of a player. The losing reel stopping unit simultaneously displays the symbols of all of the losing reels ascertained by the losing reel ascertaining unit in a stopped condition when a predetermined time has elapsed after the symbols in the plurality of reels have been displayed in a changing condition in accordance with operation information of the operating unit.

The winning reel stopping unit sequentially stops the display of the symbols in a changing condition for the winning reel ascertained by the winning reel ascertaining unit, and sequentially stops the display of the symbols in a changing condition while giving a notification of a next winning reel to be next stopped.

The game machine further includes a reel enlargement display unit for enlarging and displaying the next winning reel to be stopped.

The winning reel stopping unit stops the display of the symbols in a changing condition from a reel of a low payout to a reel of a high payout after a win has occurred for a reel group ascertained by the winning reel ascertaining unit.

The game machine further includes a payout variable unit for increasing a payout when the symbols of all of the reels are displayed in a stopped condition by the losing reel stopping unit and the winning reel stopping means and when the symbols of the plurality of reels are in a predetermined stop mode.

The game machine further includes a payout gauge display unit for displaying a payout gauge representing the range of a payout amount given depending on the modes of the symbols on the video display screen, and moving and displaying an indicator representing a current payout amount on the payout gauge after the symbols have been displayed in a changing condition. When displaying the symbols of the winning reel in a stopped condition, the winning reel stopping unit sequentially displays the symbols of a winning reel given the payout amount represented by the indicator in a stopped condition in association with the current position of the indicator moved and displayed on the payout gauge.

A program is applied to a game machine including game result determining unit for determining a game result when a predetermined condition is established, a reel video generating unit for generating a video of reels where symbols are displayed in a changing condition and then displayed in a stopped condition in accordance with the game result, and a display unit having a video display screen on which the video is displayed. The program causes a computer of the game machine to function as a game image generating unit for displaying a video of a plurality of reels on the video display screen, a losing reel ascertaining unit for ascertaining a losing reel from among the plurality of reels on the basis of the game result determined by the game result determining unit, a winning reel ascertaining unit for ascertaining a winning reel from among the plurality of reels on the basis of the game result determined by the game result determining unit, a losing reel stopping unit for displaying the symbols of the losing reel ascertained by the losing reel ascertaining unit in a stopped condition, and a winning reel stopping unit for displaying the symbols of the winning reel in a stopped condition after the symbols of all of the losing reels have been displayed in a stopped condition by the losing reel stopping unit.

According to the invention, a configuration is made such that a plurality of kinds of video reels corresponding to a symbol display game are displayed on the video display screen, and a plurality of symbol display games are executable in parallel. Accordingly, it becomes possible to significantly reduce the time until a jackpot is hit without changing the payback ratio or ratio of occurrence of a jackpot for the player. For this reason, it is possible to satisfy a person who desires to hit a jackpot early. It also becomes possible to attract people (for example, a short-tempered person or a person who does not have extra time) who tend to avoid playing in a game machine including rotation reels. It also becomes possible to improve the benefits of the parlors compared to a general game machine including a single reel unit. Since the "winning reel" which is stopped after the symbols of all of the losing reels have been displayed in a stopped condition is a reel (a reel with a winning rate of 100%) where it is assured that a win occurs when the symbols are displayed in a stopped condition, the player may enjoy only the performance of a reel where losing (missing) does not occur.

DETAILED DESCRIPTION OF THE INVENTION

Hereinafter, a preferred embodiment of the invention will be described with reference to the drawings. First, "outline of game machine and game according to the invention" and "configuration of game machine to which the invention is applied" will be described, and thereafter, a game process according to the invention will be described in detail.

<Outline of Game Machine and Game According to the Invention>

The invention is suitably applied to a game machine which executes a symbol display game where a predetermined game account is paid in accordance with the mode of a symbol when a changing symbol (hereinafter, referred to as "symbol") is stopped at a specific position. Hereinafter, description will be provided as to a game machine which is called "slot machine" installed at a game facility, such as a casino, an amusement facility, or a pachinko parlor.

In general, in a slot machine, when "one game" is defined as a display from the start of display of symbols in a changing condition in a single reel unit having one or more columns (for example, three columns) of reels until the display of the symbols in a changing condition is stopped, the symbol display game is repeatedly executed in terms of one game. Meanwhile, a game machine according to the invention includes a plurality of reel units and can simultaneously execute a plurality of symbol display games in parallel.

Hereinafter, in order to distinguish from a general slot machine, it is assumed that the term "reel" used herein means "whole reel unit (hereinafter, also referred to "hand")", not an individual reel in a reel unit corresponding to one game in the general slot machine. It is assumed that a game where individual symbol display games in a plurality of reels are simultaneously executed in the same game machine in parallel is called "multi-hand game". In the following embodiment, description will be provided for a case where a reel is constituted by a virtual rotating disk (a simulation image of a rotating disk displayed on a video display screen).

<Configuration of Game Machine to which the Invention is Applied>

First, an example of a game machine to which the invention is applied will be described.

Figure 1:
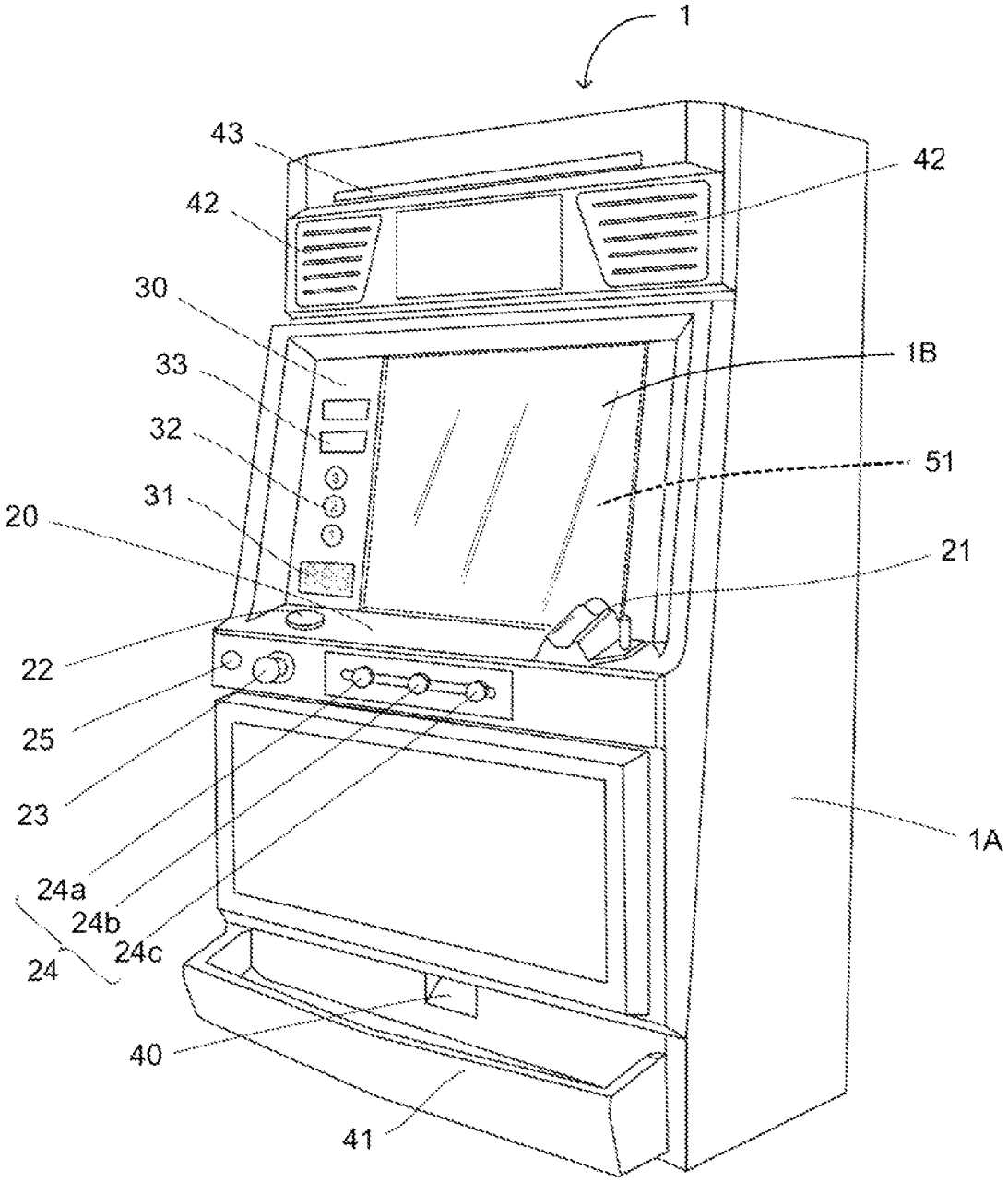
FIG. 1 is a schematic view showing an example of the exterior configuration of a game machine to which the invention is applied.

FIG. 1 is a schematic view showing an example of the exterior configuration of a game machine to which the invention is applied. A game machine 1 is provided with a display window 1B which is formed by a transparent plate having a touch panel function in the front central portion of a casing 1A, such that a video display screen 51 of a display device provided at the rear of the display window 1B can be viewed. An operation panel 20 which is operated by a player is provided below the display window 1B. An information panel 30 on which various kinds of game information are displayed is provided on the left side of the display window 1B.

In this example, the operation panel 20 has arranged thereon an insertion slot 21 into which a game medium is inserted, a bet button 22 which is used when a game medium (hereinafter, called "credit") held by a player is bet, a start lever 23 which is used to start to change symbols of a reel group displayed on the video display screen 51, an operating button (hereinafter, called "hand button) 24 which is used to select the number of symbol display games (the number of hands) to be simultaneously executed in a multi-hand game, a checkout button 25 which is used to settle the credits to the game mediums, and the like.

As the game medium, an arbitrary medium, such as medal, chip, cash, or electronic money, may be used. In the following embodiment, description will be provided as to a case where a medal is used as a game medium. Although with regard to the hand button 24, a case will be described where a single operating button 24*a* is used as a hand button, for example, a plurality of operating buttons 24*a* to 24*c* may be allocated as a hand button such that an instruction button with an increasing number of hands by 1 is regarded as the operating button 24*a*, an instruction button with an increasing number of hands by 5 is regarded as the operating button 24*b*, and an instruction button with an increasing number of hands by 10 is regarded as the operating button 24*c*.

The information panel 30 includes individual display units or a single display. The number of credited medals is displayed on a first information display unit 31 of the information panel 30, the number of bet medals for each game is displayed on a second information display unit 32, and a change in a game mode (a normal game mode or a special game mode, such as a bonus game) is displayed on a third information display unit 33.

The game machine 1 further includes a retainer box 41, which retains medals dispensed from a medal dispensing slot 40, the lower part of the casing 1A, and a speaker 42 or a light emitting device 43, which outputs sound or emits light for a performance or the like, at the upper part of the casing 1A.

Figure 2:
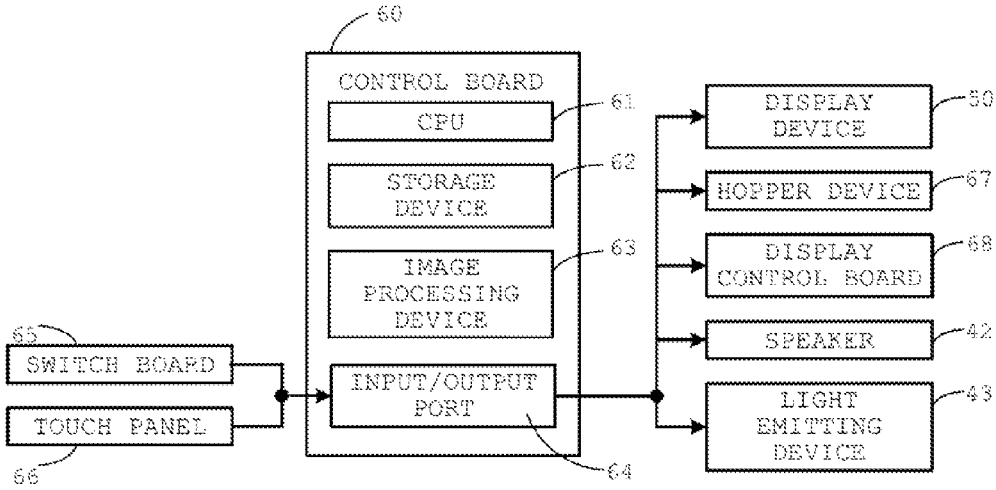
FIG. 2 is a block diagram showing the schematic configuration of hardware which is mounted in the game machine of FIG. 1.

FIG. 2 is a block diagram showing the schematic configuration of hardware which is mounted in the game machine 1 of FIG. 1. In particular, FIG. 2 shows an example of a configuration concerning a control system.

The game machine 1 is embedded with a control board 60 on which a CPU 61, a storage device 62, an image processing device 63, an input/output port 64, and the like are mounted.

The CPU 61 is an information processing device which performs the overall control of the machine as the center of a control operation of the game machine 1.

The storage device 62 is a device which stores a program or the data necessary for an operation of the game machine 1, and is constituted by a known information recording medium, such as a ROM, a RAM, a hard disk, or a flash memory, alone or in a combination of known information mediums.

The image processing device 63 is a semiconductor device which is constituted by a graphics processing unit (GPU) having an image decoder and a frame buffer, a display controller, and the like, and performs a process for generating a video displayed on the video display screen 51 of FIG. 1. In this example, the GPU of the image processing device 63 performs an image generation process, such as a geometry process or a rendering process, in accordance with a command from the CPU 61 to draw an image for each frame in the frame buffer, and drawn data is output at every predetermined time to the display controller, thereby performing a video display.

Each peripheral is connected to the control board 60 through the input/output port 64. The CPU 61 exchanges a signal with the corresponding peripheral in accordance with the program according to the invention, such that a game operation in the game machine 1 is performed.

Examples of the peripherals include a switch board 65 which detects an operation of each operating member on the operation panel 30 or insertion of medals, a touch panel 66 which is attached onto the display window 1B formed of a transparent plate and detects a position touched by a finger or the like on the display window 1B, a display device 50 which displays an image generated by the image processing device 63 on the video display screen 51 of FIG. 1, a hopper device 67 which counts the medals retained in the casing 1A and discharges the medals to the retainer box, a display control board 68 which controls the display of various display units on the information panel 30, the speaker 42, the light emitting device 43, and the like.

The touch panel 66 of FIG. 2 is an additional peripheral which is provided on the display window 1B. When the touch panel 66 is provided, a position touched by a finger or the like on the display window 1B may be detected. In this case, the touch panel 66 is used as a predetermined operating unit which is operated by the operator, such as an operating unit which is an alternative to the above-described hand button 24. For example, when the touch panel 66 is used as an operating unit which is an alternative to the hand button 24, a reel (non-game-target reel or a game-target reel) desired by the player may be selected individually or in terms of groups (for example, in terms of multiple rows) by a touch operation on the display window 1B.

<Game Process According to the Invention>

Next, a game process according to the invention will be described.

First, a game image which is displayed on the video display screen 51 of the game machine 1 will be described.

Figure 3A:
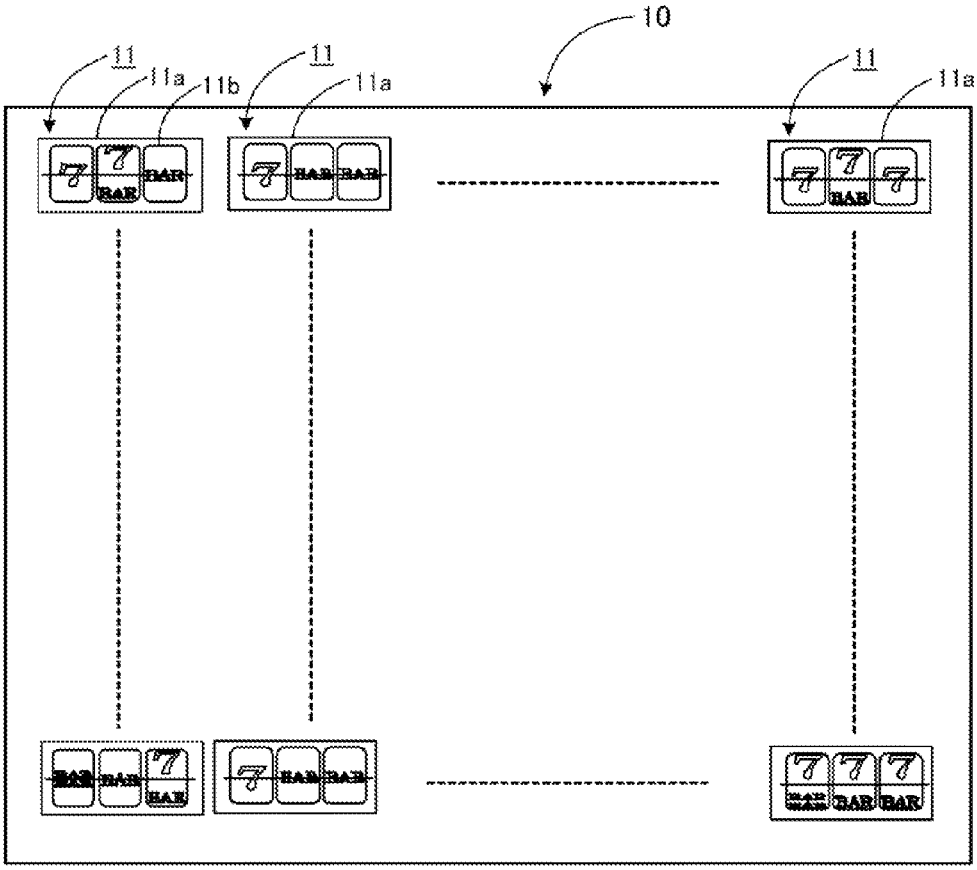
FIG. 3A is a schematic view showing a configuration example of a display screen of a multi-hand game according to the invention.
Figure 3B:
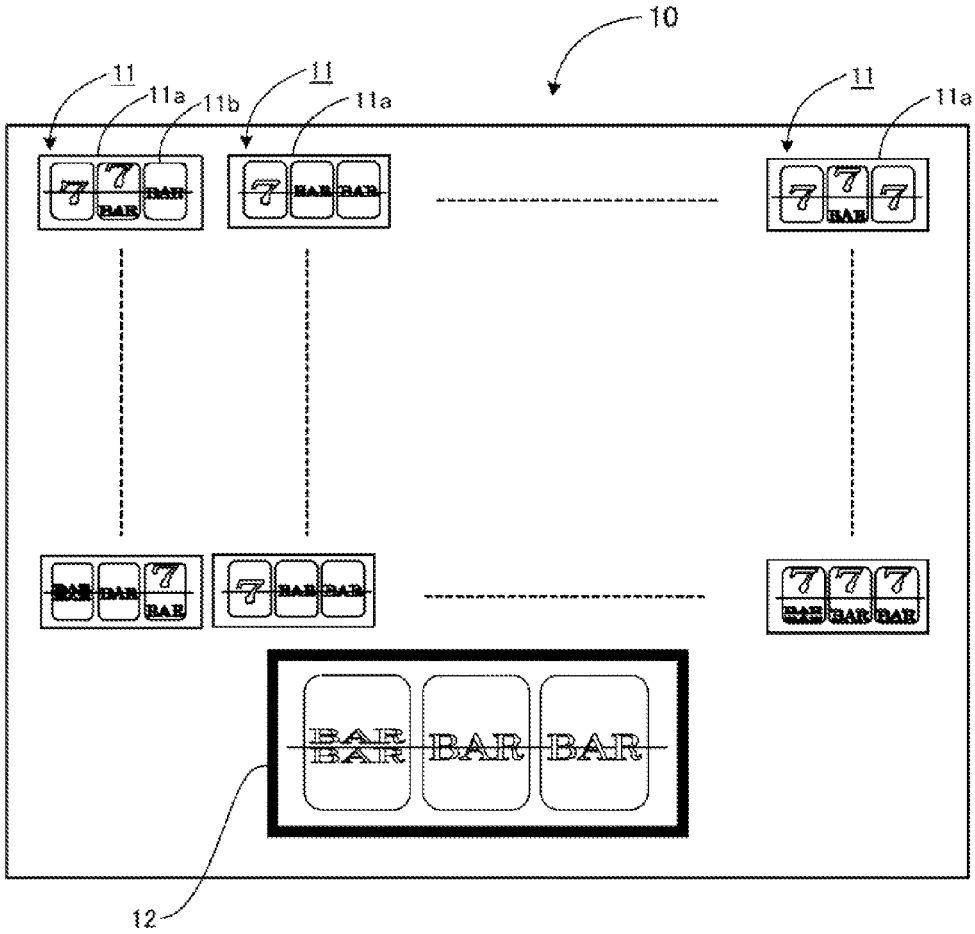
FIG. 3B is a schematic view showing another configuration example of a display screen of a multi-hand game according to the invention.

FIGS. 3A and 3B are schematic views illustrating a configuration example of a display screen 10 of a multi-hand game according to the invention. First, in this embodiment, as shown in FIG. 3A, a video where symbols 11*b* are displayed in a single symbol display window 11*a* in a changing condition are defined as a video of a single reel unit (hereinafter, abbreviated to "reel"), and an image including a plurality of reels 11 is defined as the game image of the multi-hand game. The game image is displayed on the video display screen 51 of FIG. 1 serving as the display screen 10, the symbols in a plurality of reels 11 starts to change concurrently in response to an operation of an operating unit (in this example, the start lever 23) by the operator, and a plurality of hands (an individual symbol display game corresponding to each reel 11) are simultaneously executed in parallel.

In FIG. 3A, the changing operation of the symbols 11*b* in the single symbol display window 11*a* is the same as the general symbol display game, and for example, one or a plurality of columns (in this example, three columns) of symbols 11*b* are displayed in a longitudinal direction in a changing condition. A payout (predetermined game account) in the corresponding reel 11 is given for each reel 11 in accordance with a combination of the modes of the symbols 11*b* in the symbol display window 11*a* (the modes of the symbols 11*b* displayed in a stopped condition). For example, as a result of a lottery process using a random number or the like, if it is determined that a plurality of reels 11 have won, the total value of the payouts in the winning reels 11 is given as a payout in the multi-hand game.

Although in this embodiment, a multi-hand game using all the reels 11 is a basic form, the number of game-target reels 11 (=the number of hands) can be selected by the player. For example, if the number of hands is set to 1, a general symbol display game using a single reel 11 may be executed.

Next, an enlargement display unit 12 of FIG. 3B will be described. In the screen example of FIG. 3B, the configuration of a portion where an individual reel 11 is displayed is the same as in FIG. 3A.

As shown in the configuration example of the display screen 10 of FIG. 3B, in this embodiment, since a large number of reels 11 (for example, 100 reels 11) are displayed on the same video display screen 51, the size of the individual reel 11 decreases compared to a general game machine. Accordingly, the enlargement display unit 12 is provided to enlarge and display a specific reel from a group of reels 11 displayed as a game image. In the following description, unless otherwise mentioned, description will be provided on the basis of the embodiment of FIG. 3B.

In this embodiment, the player may win a jackpot ("winning combination of a high payout" or "special combination") in a short time without decreasing a sense of expectation of a jackpot or a sense of exaltation when a win occurs, when compared to a game machine, such as a general slot machine. Accordingly, before the display of the symbols in a changing condition is stopped, for example reels (group) where it is determined that a winning rate is 0 are ascertained as "losing reels (group)". After a short time the display of the symbols of all of the losing reels have stopped, reels excluding the losing reels are defined as "winning reels (group)", and rotating winning reels are sequentially and automatically stopped. At this time, the enlargement display unit 12 displays video where the winning reel to be next stopped is enlarged. That is, for a winning reel, the player may view a large reel which is displayed on the enlargement display unit 12.

The term "winning reel" used herein refers to reels other than the losing reels (the losing reels where it is determined that the winning rate is 0) from a game-target reel group. Although in the preferred embodiment, a reel (a reel with the winning rate 100%) where it is assured that a win occurs when the changing of the symbols is stopped is defined as "winning reel", other than a reel group having a winning rate 100%, a reel group including one or more winning-unassured reel (0%<winning rate<100%) unlikely to win may be defined as "winning reel". In the latter form, for example, the symbols of a reel having a winning rate of 100% may be displayed in a stopped condition in advance, and then the symbols of the winning-unassured reel may be displayed in a stopped condition. At this time, with regard to the winning-unassured reel, for example, winning or losing (missing) of a special combination may be determined by another lottery. A form in which a reel having a winning rate 100% is defined as a "winning reel" and a form in which a reel including the winning-unassured reel is defined as a "winning reel" may be dynamically switched during a game under a predetermined condition.

Although in this embodiment, all of the losing reels are stopped in a short time, as another embodiment, some of the losing reels remain in a changing condition. In this case, in order to reduce the game time for each time, it is desirable to stop at least half of the losing reels in advance before the winning reels are stopped.

As described above, after most of the losing reels are stopped in advance, the winning-unassured reel or some of the losing reels are included in the winning reels, thereby assuring that not all of the reels after the losing reels have been stopped would be winning reels. For this reason, the game time may be reduced and simultaneously the player may feel tension about whether or not a win occurs.

In this embodiment, as a payout process, the results of the symbol display game in the individual reels 11 are added, and the stop mode of reels including all the winning modes or losing modes formed by a plurality of reels 11 is a predetermined mode set in advance, a payout is variable. Specifically, when the stop mode of reels is a mode ("special pattern" described below) in which the ratio of appearance is low, the symbols of a specific reel are changed to the symbols of a special combination (symbols given a high payout), such that a process is performed in which a payout increases in accordance with the mode of the whole game result in the multi-hand game.

Next, a specific example of a game image will be described.

Figure 4:
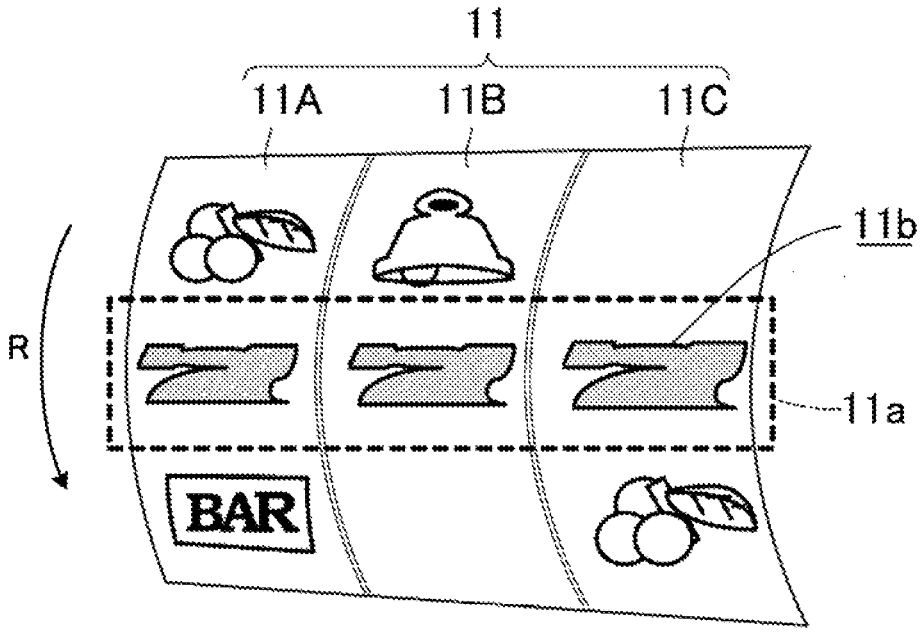
FIG. 4 is a schematic view showing an example of symbols which are displayed in each symbol display window in a changing condition.

FIG. 4 is schematic view an example of symbols 11*b* which are displayed in each symbol display window 11*a* (and the enlargement display unit 12) of FIG. 3 in a changing condition. In the symbol display window 11*a*, three-dimensional simulation images (reel images 11A to 11C) which seem to be real rotation reels are displayed. In this example, three cylindrical reel images 11A to 11C having various symbols (symbols including patterns, such as "7", "BAR", and "cherry", and blank) arranged on the peripheral surface are displayed, and the reel images 11A to 11C are rotated in accordance with an operation of the start lever 23. When the reel images 11A to 11C are stopped, as shown in the drawing, three symbols 11*b* are displayed in the symbol display window 11*a* in a stopped condition.

Figure 5:
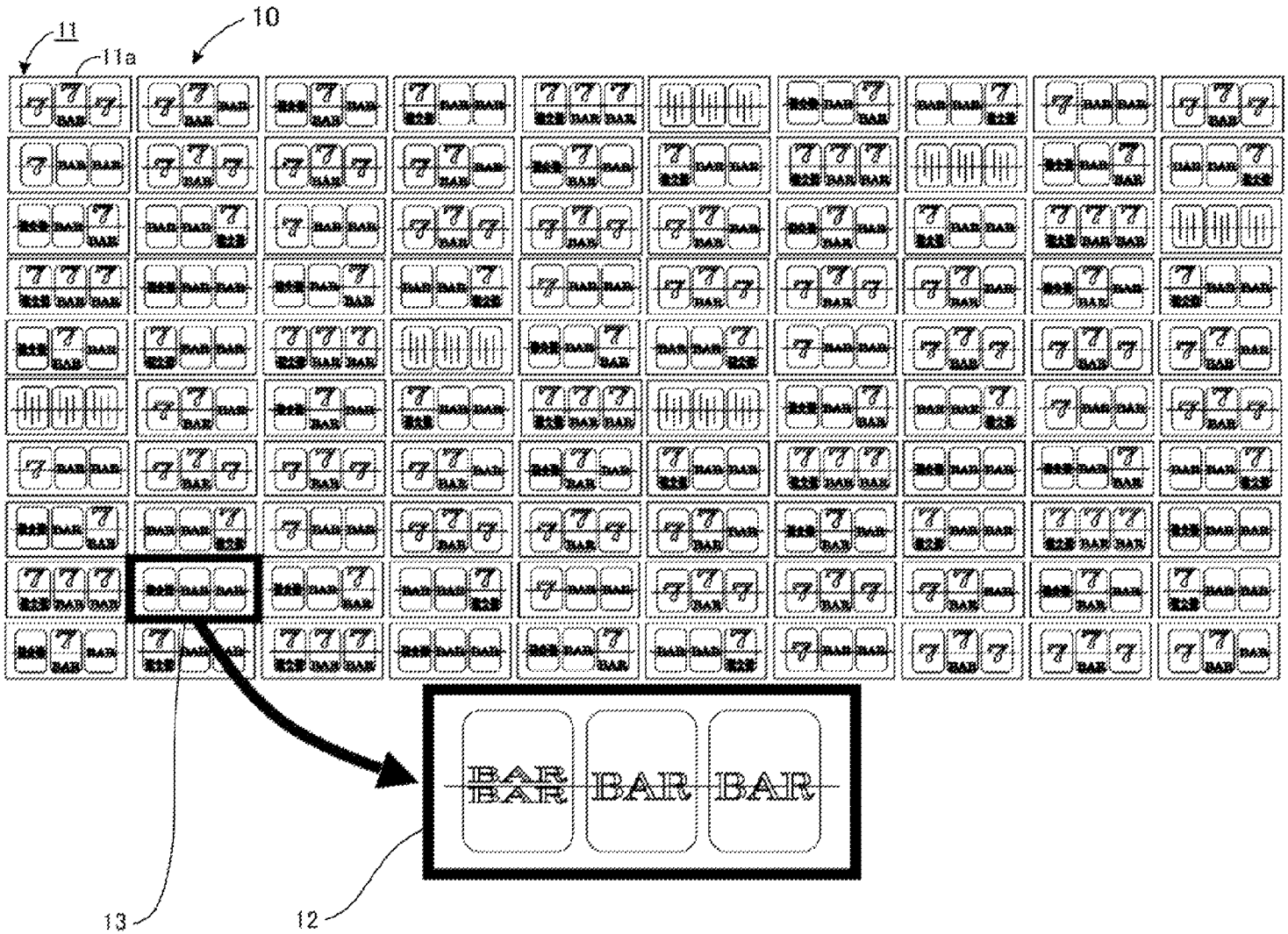
FIG. 5 is a schematic view showing a specific example of a display screen of a multi-hand game according to the invention.

FIG. 5 shows a specific example of the display screen 10 of the multi-hand game according to the invention. In this example, a screen configuration is made such that 100 reels 11 of 10 rows×10 columns are arranged on the display screen 10, and maximum 100 hands (100 symbol display games in a general slot machine) are executable simultaneously. Notification of the next winning reel to be stopped is given to the player through a marker 13 which covers the symbol display window 11*a* of the corresponding reel 11. Notification of the next winning reel to be stopped is also given to the player through an enlarged display on the enlargement display unit 12. The number of display windows 11 is not limited to the example of FIG. 5, and may be a plural number (two or more, preferably, 50 to 100). The number of display windows 11 is appropriately determined by depending on the size of the video display screen 51.

<Configuration of Game Control Means>

Figures 6, 7:
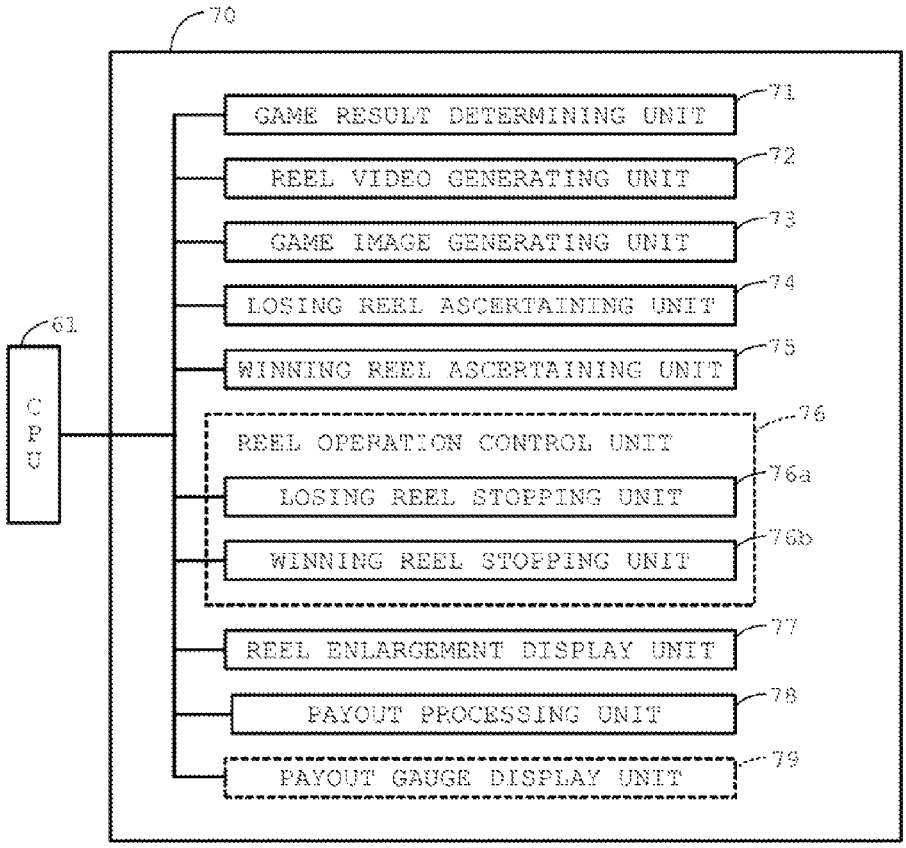
FIG. 6 is a functional block diagram showing a configuration example of a main part of a game control unit according to the invention.
FIG. 7 is a schematic view showing an example of a lottery table which is used for a game result determination process.

Next, the configuration of a game control unit according to the invention will be described. FIG. 6 is a functional block diagram showing a configuration example of a main part of the game control unit according to the invention. For convenience of description, respective units 71 to 79 which are the components of a game control unit 70 are classified by function with unit names, and are not intended to limit the software configuration. A form in which some processes are implemented by hardware falls within the invention.

The game control unit 70 shown in FIG. 6 is an information processing unit concerning execution control of the above-described multi-hand game. In this embodiment, the game control unit 70 is realized by a computer program which is controlled by the CPU 61, and the program is stored in a computer-readable storage medium. The storage medium of the program is not limited to a storage medium which is embedded in the game machine 1, and an arbitrary information storage medium including an external storage medium may be used. The game machine 1 may be connected to a server through a network, such as Internet, and software including the corresponding program may be downloaded from the server to the storage device 62 of the game machine 1.

The game control unit 70 includes, as the main components, a game result determining unit 71 for determining a game result when a predetermined condition is established, a reel video generating unit 72 for generating a video of a reel corresponding to a symbol display game (one hand) for each reel, a game image generating unit 73 for performing an image generation process in which a plurality of reels are displayed on the video display screen, a losing reel ascertaining unit 74 for ascertaining a losing reel on the basis of the game result determined by the game result determining unit 71, a winning reel ascertaining unit 75 for ascertaining a winning reel on the basis of the game result, a reel operation control unit 76 for controlling display of symbols in a plurality of reels in a changing condition and a stopped condition, a reel enlargement display unit 77 for enlarging and displaying a specific reel selected from a plurality of reels, and a payout processing unit 78 for performing a payout process in accordance with the stop mode of the symbols in the winning reel.

Hereinafter, the units 71 to 78 will be described in detail. Description of a process based on the known technique, such as an image process for giving a three-dimensional appearance like real rotation reels, will not be provided. A process concerning the execution control of a symbol display game using a plurality of reels will be described.

(1) Game Result Determining Unit 71

When the start lever 23 is operated in a state where the number of hands (the number of game-target reels) is equal to or greater than 1 and the number of bets is equal to or greater than 1, the game result determining unit 71 performs a process in the symbol display game of the corresponding reel for each game-target reel before the symbols which are displayed in a changing condition by the rotation of the reel are displayed in a stopped condition (for example, immediately after the start lever 23 is operated). The game result is determined by, for example, a lottery process using a random number or the like.

FIG. 7 is a schematic view showing an example of a lottery table LT which is used a game result determination process. The lottery table LT stores winning combination data which defines the relationship between numerical values in a predetermined range (for example, 0 to 999) and winning combinations. In the game result determining unit 71, a random number generation unit (a random number generation program or a random number generation device) generates a random number in the above-described range when the start lever 23 is operated, and the random number value is checked against the lottery table to determine a game result.

In the example of the lottery table LT of FIG. 7, "7 combination", "BAR combination", "bell combination", and "cherry combination" are respectively allocated to numerical values in ranges of "1 to 3", "4 to 9", "10 to 99", and "100 to 199". When the random number generated by the random number generation unit is a numerical value in one of the ranges, the winning combination allocated to the corresponding range is determined as a game result. When the random number generated by the random number generation unit is a numerical value out of the ranges, losing is determined as a game result. This process is performed for each game-target reel 11, and the determined game result is stored in a memory in association with the identifier (a reel ID for identifying a reel) of the corresponding reel 11 through the losing reel ascertaining unit 74 and the winning reel ascertaining unit 75. A symbol (or an arrangement/combination of symbols) and a payout amount corresponding to each winning combination are defined. In the example of FIG. 7, a payout amount (the number of dispensing medals) for each winning combination is also shown.

In the game result determining unit 71, when a predetermined condition is established, the above-described game result is determined. The condition can be arbitrarily defined, and includes, for example, the condition that a predetermined game account is inserted, the condition that a predetermined operation is made, the condition that a game ball is placed in a predetermined winning prize slot, or a combination of these conditions. In this embodiment, the game result determined by the game result determining unit 71 is temporary, losing represents a losing candidate, and winning represents a winning candidate. Finally, winning and losing are ascertained by the losing reel ascertaining unit 74 and the winning reel ascertaining unit 75.

(2) Reel Video Generating Unit 72

The reel video generating unit 72 performs a process in which, when an instruction to start a multi-hand game by an operation of the start lever 23 is detected, with regard to a group of game-target reels 11, a video (a simulation image of a reel unit having one or more rotation reels) where the symbols 11*b* are displayed in a changing condition by a video when the reel 11 rotates is generated for each reel 11.

(3) Game Image Generating Unit 73

The game image generating unit 73 performs a process in which a plurality of reels 11 generated by the reel video generating unit 72 are arranged at predetermined positions, a game image where an enlarged image of the next winning reel to be stopped is arranged in the enlargement display unit is generated, and the display screen 10 shown in FIG. 5 is displayed on the video display screen 51 through the image processing device 63. The display process of the stop operation of the reels 11 is controlled by, for example, a command from the reel operation control unit 76 described below. This command includes the game result (data representing losing, winning combination, or the like) in the corresponding reel 11 and stop operation information (data representing the stop time until the symbols are displayed in a stopped condition, or the like). In the game image generating unit 7373, for each reel 11, a process of generating a video where the symbols of the corresponding reel 11 are stopped is performed such that an intended symbol 11*b* is stopped on the line of the symbol display range 11*a* in the stop time in accordance with a command from the operation control unit 76.

(4) Losing Reel Ascertaining Unit 74

The losing reel ascertaining unit 74 ascertains a losing reel on the basis of the game result determined by the game result determining unit 71, and stores game result information representing losing in association with the corresponding reel ID. In this embodiment, the losing reel ascertaining unit 74 also functions as a payout variable unit for increasing a payout when it is determined that the losing modes by a plurality of reels are modes in which the ratio of appearance set in advance is low.

Specifically, the losing reel ascertaining unit 74 determines whether or not a losing pattern formed by a losing reel group is a predetermined pattern (a losing pattern having a low ratio of appearance: hereinafter, called "first special pattern") which rarely appears on the basis of game result information of all the game-target reel groups. When it is determined to be the first special pattern, a process in which a special combination (a combination given a high payout) corresponding to the first special pattern is set or a process in which some reels are changed from a losing reel to a winning reel (for example, a winning reel which becomes a special combination) is performed. That is while the individual symbol display game is losing a process is performed in which, it is regarded to be winning as the whole of the game, and a payout is given.

As the first special pattern, for example, a pattern having low probability of appearance, such as a pattern where the number of hands is equal to or greater than a predetermined value and all the hands are losing, or a pattern where there are n rows (or n columns: for example, n=3) of reels all the symbols of a losing reel are blank, is set in advance. Instead of the form in which the special combination is set, a form in which a bonus game is executed and a large number of game mediums can be acquired may be used, or a form in which these forms may be executed in accordance with the mode of the first special patter may be used.

(5) Winning Reel Ascertaining Unit 75

The winning reel ascertaining unit 75 ascertains a reel group excluding losing reels (a reel group which is never likely to win) as "winning reel" on the basis of the game result determined by the game result determining unit 71, and stores game result information representing a winning combination in association with the corresponding reel ID. In this embodiment, while the game result determining unit 71 determines the game result, such as a winning combination, at the time of starting the multi-hand game, the determination is temporary, and the winning reel ascertaining unit 75 finally ascertains the winning combination. For example, although it is preferable that a reel (a reel having a winning rate 100%) where it is assured that a win occurs when the changing of the symbols is stopped is processed as a "winning reel", a reel group including one or more reels (winning-unassured reels), which are unlikely to win when the change of the symbols is stopped, may be processed as a "winning reel", and for some reels (winning reels which satisfy the minimum requirement of the winning range) of a reel group for which winning was ascertained by a lottery process or the like, the lottery process is performed again to finally ascertain winning. At this time, for example, a process may be performed in which the numerical value of the lottery table LT of FIG. 7 is variable, thereby increasing a probability that a special combination of a high payout (in the example of FIG. 7, "7 combination") occurs.

In this embodiment, the winning reel ascertaining unit 75 also functions as a payout variable unit for increasing a payout when it is determined that the winning modes by a plurality of reels are modes having a low ratio of appearance set in advance.

Specifically, after the "winning reel" has been ascertained, the winning reel ascertaining unit 75 determines whether or not a winning pattern by a winning reel group is a predetermined pattern (a winning pattern having low probability of appearance: hereinafter, called "second special pattern") which rarely appears. When it is determined to be the second special pattern, a process is performed in which a special combination (a combination given a high payout) corresponding to the second special pattern is set.

Figure 8:
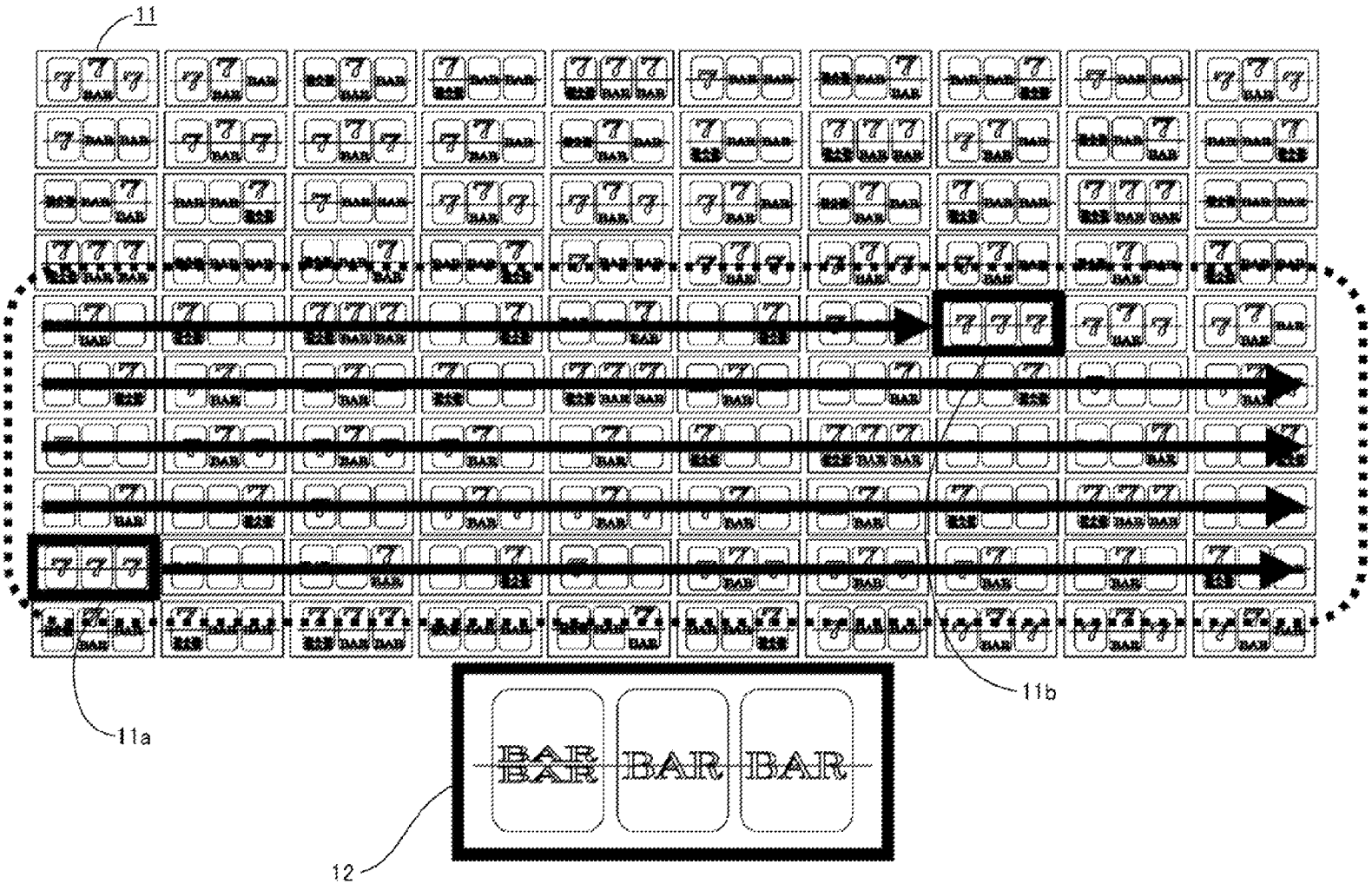
FIG. 8 shows a first screen example for illustrating a process at the time of special pattern detection in a multi-hand game according to the invention.
Figure 9:
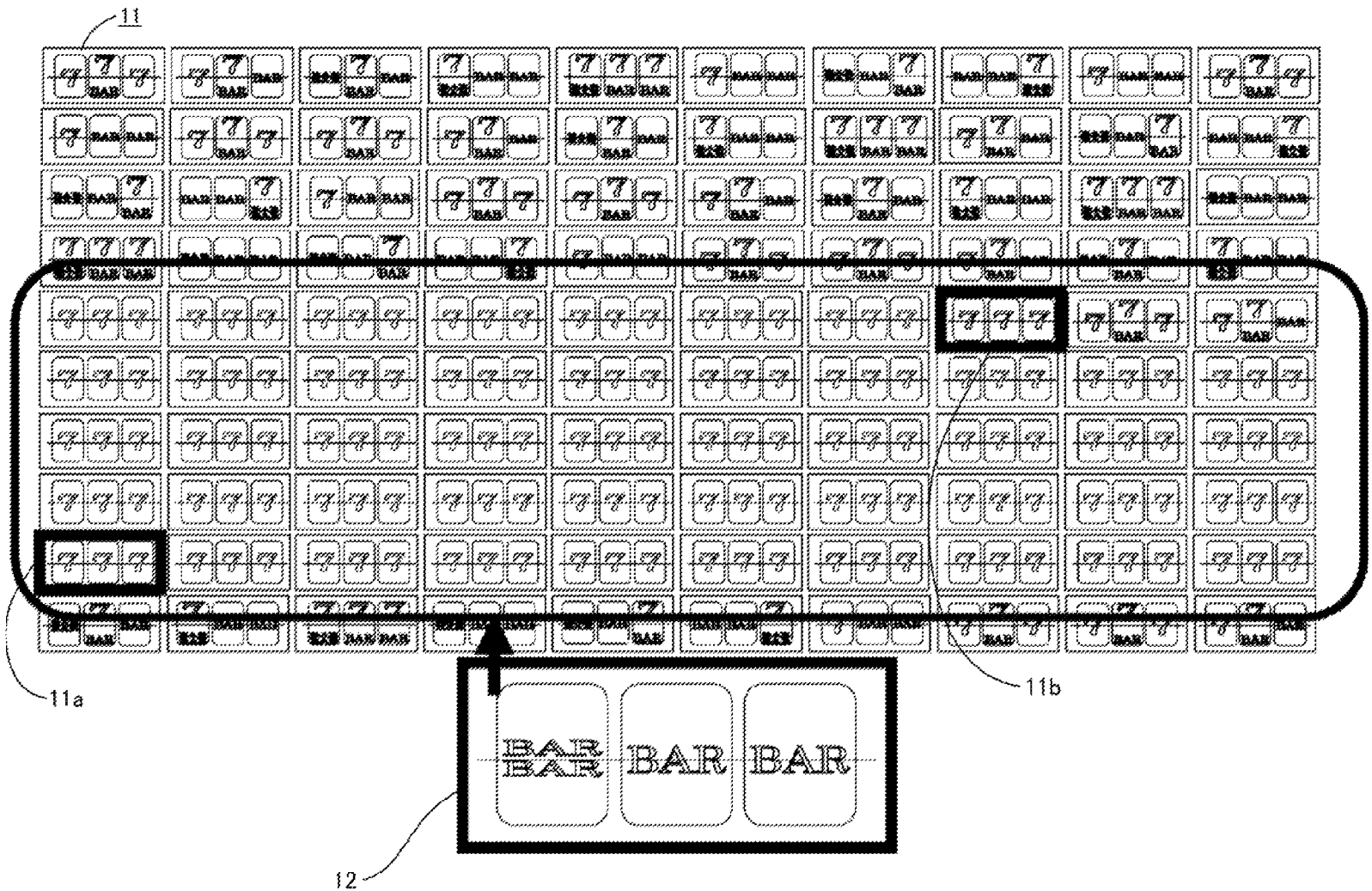
FIG. 9 shows a second screen example for illustrating a process at the time of special pattern detection in a multi-hand game according to the invention.

As the second special pattern, for example, a pattern having low probability of appearance, such as a pattern where there are a plurality of special combinations (in the example of FIG. 7, "7 combination") with a high payout, called a jackpot, or a pattern where there are m rows (or m columns: for example, m=2) of reels of the same combination, is set in advance. Instead of the form in which the special combination is set, a form in which a bonus game is executed and a large number of game mediums can be acquired may be used, or a form in which these forms may be executed in accordance with the mode of the second special pattern may be used. In this embodiment, for example, as shown in FIG. 8, when a pattern where there are a plurality of special combinations with a high payout is detected, as shown in FIG. 9, a process is performed in which the symbols of all reels between two winning reels 11*a* and 11*b* (when there are three or more winning reels, winning reels at both ends in the row direction) where a special combination with a high payout occurs are changed to the symbols of the special combination.

(6) Reel Operation Control Unit 76

The reel operation control unit 76 is a unit for controlling the display of the symbols of each reel in a changing condition and a stopped condition through the rotation control of each reel for a game-target reel group. The reel video generating unit 72 is instructed to display the symbols of the corresponding reel in a changing condition and a stopped condition.

In this embodiment, the reel operation control unit 76 includes a losing reel stopping unit 76*a* for displaying the symbols of each losing reel ascertained by the losing reel ascertaining unit 74 in a stopped condition, and a winning reel stopping unit 76*b* for displaying the symbols of each winning reel ascertained by the winning reel ascertaining unit 75 in a stopped condition. After the symbols of all of the losing reels have been displayed in a stopped condition by the losing reel stopping unit 76*a*, the symbols of each winning reel are displayed in a stopped condition by the winning reel stopping unit 76*b*. At this time, in a preferred embodiment, the following processes (a) to (d) are performed. In other embodiments described below, the following process (e) is performed.

(a) The losing reel stopping unit 76*a* performs a control such that the symbols of all of the losing reels ascertained by the losing reel ascertaining unit 74 are in a stopped condition when a predetermined time has elapsed after the symbols of the game-target reel group have been displayed in a changing condition in accordance with detection information relating to the operation of the start lever 23.

(b) The winning reel stopping unit 76*b* handles each winning reel as a winning-assured reel where the game result is winning and performs a control such that the rotation of each reel is sequentially stopped to display the symbols of each winning reel in a changing condition.

(c) When sequentially stopping the rotation of each winning reel, the winning reel stopping unit 76*b* performs a control such that the rotation of each winning reel is sequentially stopped while giving notification of a next winning reel to be stopped. In this embodiment, for example, as shown in FIG. 5, the winning reel stopping unit 76*b* gives notification to the player through a marker 13 (or a change in color of the symbol display frame 11*a*, blinking, or the like) which covers the symbol display frame 11*a* of the next winning reel to be stopped, and enlarges and displays the winning reel on the enlargement display unit 12 of the video display screen to give notification of the next winning reel to be stopped to the player.

(d) The winning reel stopping unit 76*b* performs a control such that, for the winning reels ascertained by the winning reel ascertaining unit 75, the display of the symbols in a changing condition is sequentially stopped from a winning reel with a low payout to a reel with a high payout after a win has occurred.

(e) The winning reel stopping unit 76*b* performs a control such that, in an embodiment in which the symbols of the corresponding reel are displayed in a stopped condition in association with a payout gauge described below, the symbols of the corresponding reel corresponding to a payout amount represented by an indicator are displayed in a stopped condition in association with the current position of the indictor moved and displayed on the payout gauge.

(7) Reel Enlargement Display Unit 77

The reel enlargement display unit 77 performs a control such that, when the winning reel is sequentially stopped by the winning reel stopping unit 76*b*, notification of the next winning reel to be stopped is given to the game image generating unit 73, and an enlarged image of the next winning reel to be stopped is displayed on the enlargement display unit.

In the example of FIG. 5, the reel represented by the marker 13 is a next winning reel to be stopped, and an enlarged video of the reel is displayed on the enlargement display unit 12. Accordingly, it becomes for the player to view the stopping of the symbols of each winning reel to be sequentially stopped on the enlargement display unit 12.

(8) Payout Processing Unit 78

With regard to a winning reel group ascertained by the winning reel ascertaining unit 75, the payout processing unit 78 performs a payout process for adding a value obtained by multiplying a payout amount (the number of paying medals) defined in correspondence with a winning combination and the number of bets to the number of credits (the number of medals held by the player) for each winning reel. As shown in FIG. 7, the payout amount is a payout amount which is stored in association with a winning combination.

The payout processing unit 78 performs the payout process for each winning reel and also performs the following special payout process.

<Special Payout Process 1> A payout process in which, when a process for setting a special combination corresponding to the above-described first special pattern by the losing reel ascertaining unit 74 is performed or when a process for setting a special combination corresponding to the above-described second special pattern by the winning reel ascertaining unit 75 is performed, a payout amount determined by depending on the special combination is added to the number of credits.

<Special Payout Process 2> A payout process in which, a bonus game is executed, a payout amount determined by depending on the execution result is added to the number of credits.

As described above, although the game control unit 70 includes the game result determining unit 71 to the payout processing unit 78 as the main components, in another embodiment described below, the payout gauge display unit 79 is further provided. The payout gauge display unit 79 is a unit for displaying a payout gauge representing the range of a payout amount given depending on the mode of symbols on the video display screen and also moving and displaying an indicator representing the current payout amount on the payout gauge after the symbols have been displayed in a changing condition.

Specifically, though it will be described below with reference to the drawings, in an embodiment in which the payout gauge display unit 79 is provided, when stopping the display of the symbols in a changing condition by stopping the rotation of the winning reel, the winning reel stopping unit 76*b* sequentially stops the rotation of the winning reel in association with the current position of the indicator moved and displayed on the payout gauge. For example, in the example of the lottery table LT of FIG. 7, the indicator on the payout gauge is moved from 0 toward 500, and if the indicator reaches a position corresponding to five, the winning reel stopping unit 76*b* stops the symbols of the winning reel group where the payout amount (the number of paying medals) is 5. Thereafter, if the indicator reaches a position corresponding to 15, the symbols of a winning reel group where the payout amount is 15 are stopped. In this way, the display of the symbols in a changing condition is stopped from a reel with a low payout to a reel with a high payout after a win has occurred in association with the motion of an indicator which represents the payout amount.

<Operation Example of Game Machine (Flow of Process in Multi-Hand Game)>

In the above-described configuration, the flow of a process in a multi-hand game which is executed in the game machine 1 according to the invention will be described with reference to a flowchart. Description of the processes which have already been described will not be provided or will be simplified.

Figure 10:
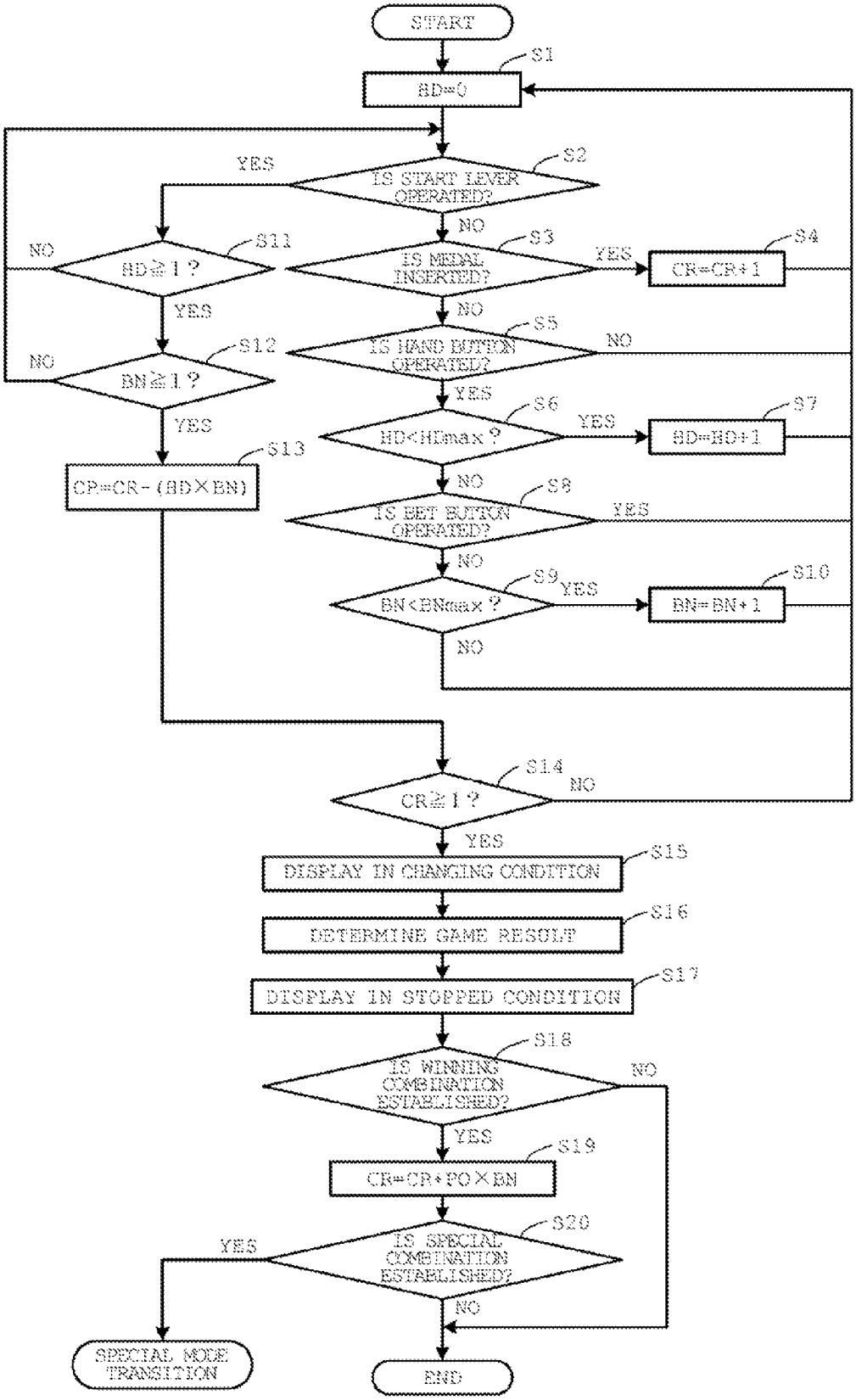
FIG. 10 is a flowchart illustrating the overall flow of a game process according to the invention.

First, the overall flow of a game process according to the invention will be described with reference to a flowchart of FIG. 10. In FIG. 10, "HD" denotes a counter value (hereinafter, called "the number HD of hands") which represents the number of symbol display games (=the number of game-target reels) to be simultaneously executed. "CR" denotes a credit value (hereinafter, called "the number HD of credits") which represents the number of medals held by the player. "BN" denotes a counter (hereinafter, called "the number BN of bets") for each reel (for each hand) which represents the number of medals bet as game consideration. "PO" denotes the number of paying medals (hereinafter, called "payout amount PO") which is defined in correspondence with a winning combination.

The game control unit 70 of the game machine 1 first initializes the number HD of hands as an initialization process of a multi-hand game (Step S1), and then performs a process after Step S2.

First, the presence/absence of a game start instruction (in this example, the operation of the start lever 23 in FIG. 1) by the player is checked (Step S2). If it is determined that the operation of the start lever 23 is absent, the presence/absence of insertion of a medal into the insertion slot 21 (Step S3), the presence/absence of an operation to instruct the number of hands by the hand button 24 (Step S5), and the presence/absence of a bet operation by the bet button 22 (Step S8) are respectively checked.

In Step S3, if the insertion of medals is detected, the number of inserted medals is added to the number CR of credits each time a medal is detected (Step S4). In Step S5, if the operation to instruct the number HD of hands is detected, the number HD of hands is updated under the condition that the number HD of hands is smaller than the maximum number HDmax of hands (Yes in Step S6) (Step S7).

In Step S8, if a bet operation is detected, the number BN of bets and the number CR of credits are updated under the condition that the number BN of bets is smaller than the maximum number BNmax of bets (Yes in Step S9) (Step S10).

In Step S2, if the operation of the start lever 23 is detected, as illustrated in Steps S11 to S14, it is determined whether or not the following conditions (a) to (c) are all satisfied. When it is determined that the conditions are satisfied, it is determined that the start condition of the multi-hand game is established, and the multi-hand game using the corresponding reel starts to be executed.

Condition (a): the number HD of hands is equal to or greater than 1 (Yes in Step S11).

Condition (b): the number BN of bets is equal to or greater than 1 (Yes in Step S12).

Condition (c): the number CR (CR=CR−(HD×BN)) of credits calculated in Step S13 is equal to or greater than 1 (Yes in Step S14).

The game control unit 70 first simultaneously rotates the game-target reels 11 to concurrently start the display of the symbols of the respective reels 11 in a changing condition (Step S15), and also performs a process in which a game result is determined for each game-target reel 11 by the game result determining unit 71 (Step S16).

Subsequently, with regard to each of the game-target reels 11 (the reels 11 for the number HD of hands) the game control unit 70 stops the rotation of the corresponding reel 11 to display the symbols in a stopped condition. At this time, the rotation of the corresponding reel 11 is controlled such that the symbols matching the game result are displayed in a stopped condition (Step S17).

With regard to each game-target reel 11 where the symbols are displayed in a stopped condition, in Step S16, it is determined whether or not a winning combination is established on the basis of the determined game result (Step S18). When a winning combination is established, a process in which a value obtained by multiplying the payout amount PO defined in correspondence with the winning combination and the number BN of bets is added to the number CR of credits (Step S19).

Subsequently, it is determined whether or not a special combination (a specific winning combination, such as "7 combination", or a special combination corresponding to the first special pattern or the second special pattern) is established (Step S20). When a special combination is not established, the current process of the multi-hand game ends, and is entered into a standby state. Meanwhile, when it is determined in Step S20 that a special combination is established, the game mode is changed from a normal mode to a special mode, and a process in the special mode is performed. As the process in the special mode, a process for increasing the payout (a payout process according to a special combination) is performed or a bonus game is executed, then, the game mode is changed from the special mode back to the normal mode, and subsequently, the current process of the multi-hand game ends.

Figure 11:
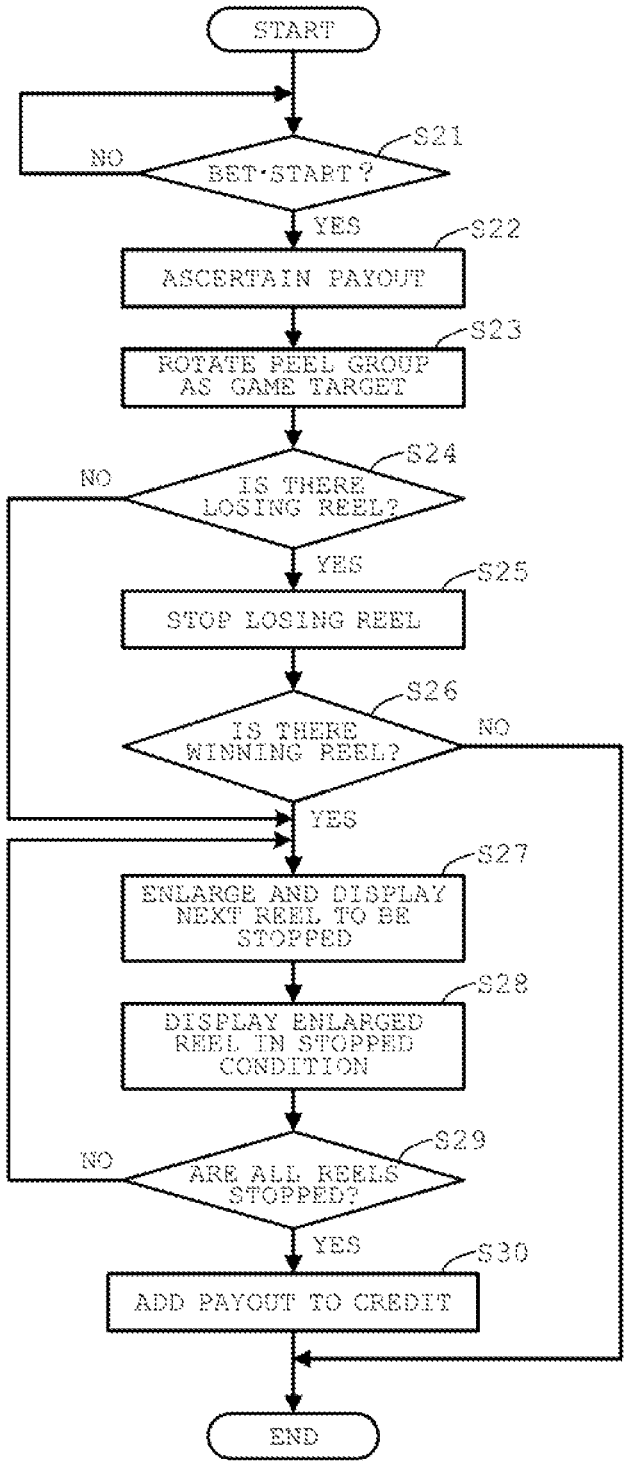
FIG. 11 is a flowchart illustrating operation control of a plurality of reels according to the invention.

Next, the operation control of a plurality of reels and the payout process in the multi-hand game according to the invention will be described with reference to a flowchart of FIG. 11. A process in the normal mode will be described, and description of a process in the special mode will not be provided.

The game control unit 70 determines whether or not the start condition (a predetermined condition, such as a bet operation for each game-target reel, the operation of the start lever, or the like) of the multi-hand game is established (Step S21). When it is determined that the start condition is established, first, the game result is determined for each game-target reel when the operation of the start lever has been detected, and then it performs a process for ascertaining a payout for each game-target reel on the basis of the game result by the payout processing unit 78 (Step S22). Simultaneously, the game control unit 70 performs a process for simultaneously rotating the respective game-target reels to start displaying the symbols of the reel group in a changing condition on the video display screen (Step S23).

Subsequently, the game control unit 70 checks the presence/absence of a losing reel (Step S24). When there is a losing reel, with regard to all of the losing reels, the rotation speed of each reel decreases to 0 to concurrently stop the changing of the symbols of the losing reel on the video display screen (Step S25). Thereafter, the presence/absence of a winning reel is checked (Step S26). When it is determined that there are no winning reels, the corresponding process of the multi-hand game ends.

On the other hand, when it is determined in Step S26 that there is a winning reel, the game control unit 70 sequentially stops respective reels in a rotating reel group (winning reel group) in a predetermined sequence. At this time, a next winning reel to be stopped (for example, a near-lower left reel from among rotating reels) is selected, and as illustrated in FIG. 5, enlarged and displayed on the enlargement display unit 12 (Step S27). The rotation speed of the reel (and an original reel represented by the marker 13) displayed on the enlargement display unit 12 decreases, and an intended symbol according to the game result is stopped on the line of the symbol display frame (Step S28). Subsequently, it is determined whether or not the rotating reel group is stopped (Step S29). If there is a reel being not stopped, the process returns to Step S27, the process of Steps S27 and S28 is repeated until all of the reels are stopped.

When it is determined in Step S29 that the rotating reel group is stopped, in Step S22, a process in which the ascertained payout is added to the number CR of credits is performed, and the process of the multi-hand game in the normal mode ends.

Although in Step S27, an example has been described where a near-lower left reel on the video display screen from among rotating winning reels is selected as a next winning reel to be stopped, and reels are sequentially stopped on the basis of the arrangement position of a reel group arranged in a matrix such that the reels are sequentially stopped from the left end to the right end in the lowermost row, from the left end to the right end in the next row, . . . , and from the left end to the right end in the uppermost row, the sequence in which the rotation of the winning reel group is stopped is not limited to the above-described sequence. For example, from the viewpoint of improving a sense of expectation of a jackpot (special combination) imposed on the player or a sense of exaltation when a jackpot occurs, as described above, it is preferable that, the display of the symbols of the corresponding reel in a changing condition are stopped from a reel with a low payout to a reel with a high payout after a win has occurred.

Another Embodiment

Next, another embodiment relating to the operation control of a plurality of reels in the multi-hand game according to the invention will be described.

Figure 12:
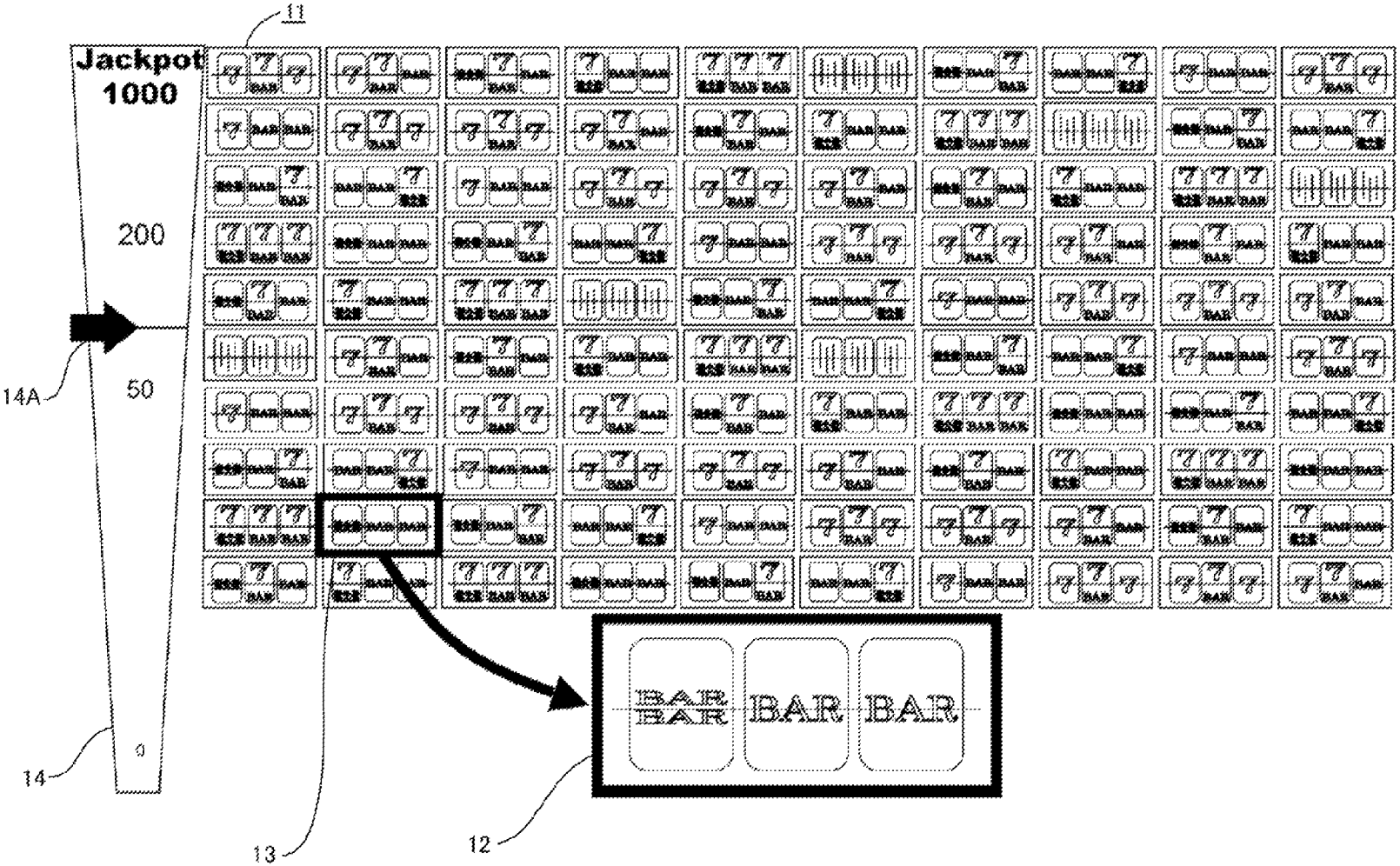
FIG. 12 shows a screen example for illustrating another embodiment of the invention.

In the following embodiment, the payout gauge display unit 79 is provided, and after the display of the symbols of all of losing reel groups from among game-target reel groups in a changing condition is simultaneously stopped, the rotation of a winning reel group is sequentially stopped in association with the motion of an indicator 14A which is moved and displayed on a payout gauge 14 illustrated in FIG. 12. The payout gauge 14 of FIG. 12 is a gauge which represents the range (the range from the minimum number of paying medals to the maximum number of paying medals) of a payout amount defined depending on the type of a winning combination in the symbol display game. The indicator 14A is an indicator which represents the current payout amount by an arrow or the like.

Hereinafter, the flow of a process in the embodiment in which the payout gauge display unit 79 is provided will be described with reference to a screen example of FIG. 12 and a flowchart of FIG. 13.

Figure 13:
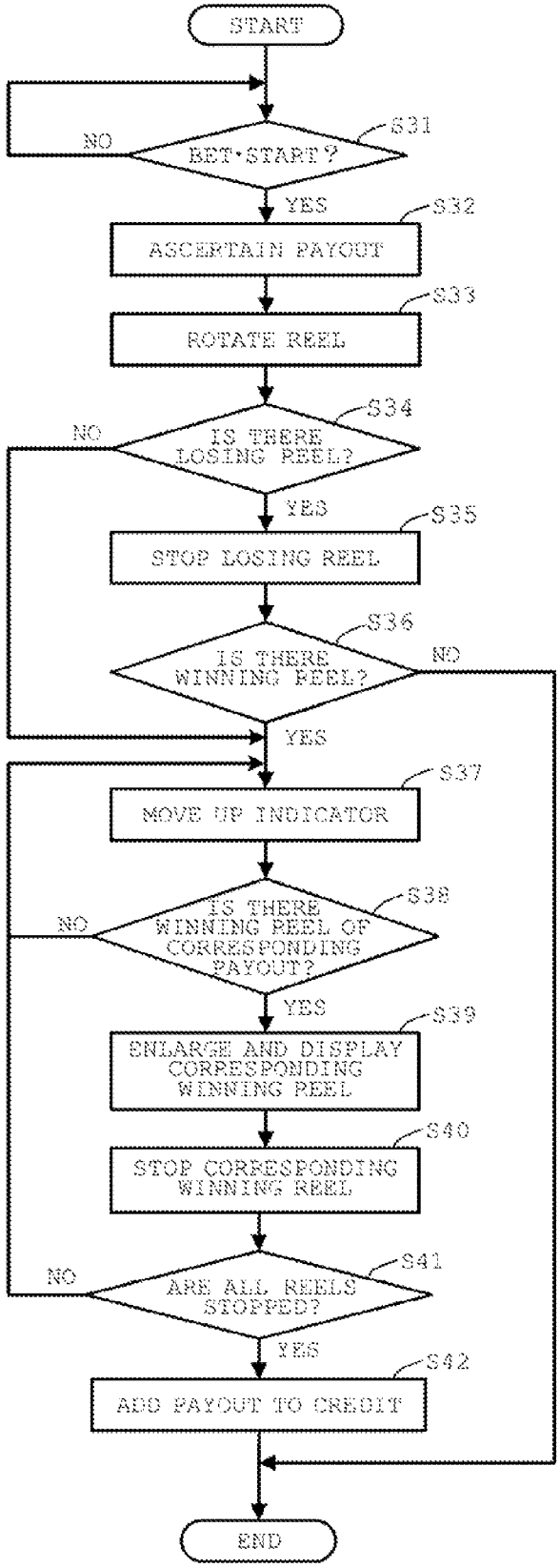
FIG. 13 is a flowchart illustrating another embodiment of the invention.

The process (the process until the rotation of a losing reel group is completely stopped) of Steps S31 to S36 in the flowchart of FIG. 13 is the same as the process of Steps S21 to S26, thus description thereof will not be repeated. Description will be provided as to a process after Step S37.

After the rotation of the losing reel group has been completely stopped, the game control unit 70 of the game machine 1 moves the indicator 14A of the payout gauge 14 of FIG. 12. At this time, in this example, the indicator 14A moves up at a predetermined speed from the payout amount of 0 toward the maximum value (for example, 1000) (Step S37).

In the game control unit 70, it is determined whether or not there is a winning reel with a payout corresponding to the current position of the indicator 14A (Step S38). When it is determined that there is the corresponding winning reel, after the moving-up of the indicator 14A has been temporarily stopped, the corresponding winning reel is enlarged and displayed on the enlargement display unit 12 (Step S39), and a process for stopping the winning reel is performed. At this time, when there are winning reels, as described above, a process is performed in which the winning reels are sequentially stopped while giving notification of a next winning reel to be stopped to the player through display on the enlargement display unit 12 or the marker 13 (Step S40). Subsequently, it is determined whether or not all of the reels are stopped (Step S41). When it is determined that there is a reel being not stopped, the process returns to Step S37. The process of Steps S37 to S40 is repeated until all of the reels are stopped.

If it is determined in Step S41 that all of the reels are stopped, a process is performed for adding the payout of each winning reel to the credit, and the process of the multi-hand game in the normal mode ends.

Another Embodiment

Although in the above-described embodiment, an example has been described where a plurality of symbol display games of the same type are executed simultaneously, symbol display games of different types (for example, symbol display games of two or more types which are different in the occurrence probability of a special combination, the payout amount, the types or the number of symbols, the number of reels, the number of winning prize lines, or the like) may be executed simultaneously.

Although an example has been described where the arrangement of the reels 11 is a matrix arrangement, the invention is not limited thereto. For example, there may be various arrangement forms, such as a form in which reels are arranged circularly around the enlargement display unit 12, a form in which the symbol display windows (group) of respective reels 11 are arranged on both sides of the enlargement display unit 12, a form in which reels are correspondingly arranged in divided regions by group (for example, by type when symbol display games of different types are executed), and the like.

In the above-described embodiment, an example has been described where a losing reel is displayed in a stopped condition, and winning reels stops sequentially. However, for example, after a losing reel has been displayed in a stopped condition, the losing reel may be erased from the display screen, and only a winning reel may be displayed. After the losing reel has been erased, the winning reel or the enlargement display unit may be enlarged and displayed compared to the normal size.

Although in the above-described embodiment, an example has been described where the enlargement display unit 12 is provided on the video display screen, and a video of enlarged simulation images of the reels 11 is displayed, an enlargement display unit may be provided in a region different from the video display screen, the enlargement display unit may be constituted by a screen which is curved in an arc shape, and an enlarged image may be projected on the screen using display unit, such as a projector. The enlargement display unit may be constituted by a mechanical reel unit having an actual rotating disk.

Although in the above-described embodiment, an example has been described where a plurality of reels 11 are fixedly arranged, for example, the display size of an individual reel may be calculated in accordance with the number of hands specified by the player and the size of the display, and a display screen where respective reels of the corresponding display size are arranged may be automatically generated. Alternatively, a plurality of display patterns may be provided, and game screens which are different in the number of display windows 11 (and the size), for example, a display screen having 100 display windows 11 and a display screen having 50 display windows 11 may be switched and displayed in accordance with a selection operation of the player (or the manager of the parlor).

Although in the above-described embodiments, a case has been described where all the reels are automatically stopped, for example, a reel (winning reel) displayed on the enlargement display unit may be stopped by the player (for example, stopped by the operating buttons 24*a* to 24*c* of FIG. 1).

Although in the above-described embodiments, a case has been described where the rotation direction of the reels is the longitudinal direction with respect to the display screen, for example, the rotation direction may be a lateral direction or an oblique direction with respect to the display screen.

The invention claimed is:

1. A game machine comprising:

a game result determining unit configured to determine a game result when a predetermined condition is established;

a reel video generating unit configured to generate video of a plurality of reels where symbols are displayed in a changing condition and then displayed in a stopped condition in accordance with the game result;

a display unit having a video display screen on which the video is capable of being displayed;

a game image generating unit configured to display video of the plurality of reels on the video display screen;

a losing reel ascertaining unit configured to ascertain one or more losing reels having a winning rate of 0 from among the plurality of reels on the basis of the game result determined by the game result determining unit;

a winning reel ascertaining unit configured to ascertain one or more winning reels other than the one or more losing reels from a game target reel group from among the plurality of reels on the basis of the game result determined by the game result determining unit;

a losing reel stopping unit configured to display the symbols of the one or more losing reels ascertained by the losing reel ascertaining unit in a stopped condition;

a winning reel stopping unit configured to display the symbols of the one or more winning reels in a stopped condition after the symbols of all of the one or more losing reels have been displayed in a stopped condition by the losing reel stopping unit; and a wagering unit configured to enable a player to wager on one or more games, each game associated with a different one of the plurality of reels.

2. The game machine according to claim 1, wherein the one or more winning reels indicates that a win has occurred when the symbols are displayed in a stopped condition.

3. The game machine according to claim 1, further comprising an operating unit that starts to change the symbols in the plurality of reels in response to an operation of a player, wherein the losing reel stopping unit simultaneously displays the symbols of all of the losing reels ascertained by the losing reel ascertaining unit in a stopped condition when a predetermined time has elapsed after the symbols in the plurality of reels have been displayed in a changing condition in accordance with operation information of the operating unit.

4. The game machine according to claim 1, wherein the winning reel stopping unit sequentially stops the display of the symbols in a changing condition for the one or more winning reels ascertained by the winning reel ascertaining unit, and sequentially stops the display of the symbols in a changing condition while giving notification of a next winning reel to be stopped.

5. The game machine according to claim 4, further comprising a reel enlargement display unit configured to enlarge and display the next winning reel to be stopped.

6. The game machine according to claim 1, wherein the winning reel stopping unit stops the display of the symbols in a changing condition from a low payout reel to a high payout reel, each payout being ascertained on the basis of the game result by a payout processing unit for a reel group ascertained by the winning reel ascertaining unit, and ordering the one or more winning reels based upon an increasing value of payouts prior to stopping the display of the symbols according to a determined order or to match a payout indicated by an indicator.

7. The game machine according to claim 1, further comprising a payout variable unit that increases a payout when the symbols of all of the plurality of reels are displayed in a stopped condition by the losing reel stopping unit and the winning reel stopping unit and when the symbols of the plurality of reels are in a predetermined stopped form.

8. The game machine according to claim 1, further comprising a payout gauge display unit configured to display a payout gauge representing the range of a payout amount given depending on the forms of the symbols on the video display screen, and moving and displaying an indicator representing a current payout amount on the payout gauge after the symbols have been displayed in a changing condition, wherein, when displaying the symbols of the one or more winning reels in a stopped condition, the winning reel stopping unit sequentially displays, in a stopped condition, in association with the current position of the indicator moved and displayed on the payout gauge, the symbols of the one or more winning reels giving the current payout amount represented by the indicator, and ordering the one or more winning reels based upon an increasing value of payouts prior to displaying the symbols of the one or more winning reels in a stopped condition according to a determined order or to match the current payout amount represented by the indicator.

9. A computer-readable medium storing a program on a non-transitory storage medium which is applied to a game machine including a game result determining unit that determines a game result when a predetermined condition is established, a reel video generating unit that generates video of a plurality of reels where symbols are displayed in a changing condition and then displayed in a stopped condition in accordance with the game result, a display unit that has a video display screen on which the video is displayed, and a wagering unit configured to enable a player to wager on one or more games, each game associated with a different one of the plurality of reels, the program causing a computer to execute steps comprising:

displaying video of the plurality of reels on the video display screen;

ascertaining one or more losing reels having a winning rate of 0 from among the plurality of reels on the basis of the game result determined by the game result determining unit;

ascertaining one or more winning reels other than the losing reels from a game target reel group from among the plurality of reels on the basis of the game result determined by the game result determining unit;

displaying the symbols of the one or more losing reels ascertained by the losing reel ascertaining unit in a stopped condition; and displaying the symbols of the one or more winning reels in a stopped condition after the symbols of all of the losing reels have been displayed in a stopped condition by the losing reel stopping unit.

* * * * *